US005846144A

United States Patent [19]

Bothers

[11] Patent Number: 5,846,144

[45] Date of Patent: Dec. 8, 1998

[54] HOCKEY PUCK STORAGE AND DELIVERY DEVICE

[76] Inventor: Charles A. Bothers, 5 Voorhees Rd., Whitehouse Station, N.J. 08889

[21] Appl. No.: 7,810

[22] Filed: Jan. 15, 1998

[51] Int. Cl.[6] ..... A63B 71/02

[52] U.S. Cl. ..... 473/446

[58] Field of Search ..... 473/446; 124/41.1, 124/42, 43, 45, 46, 47, 49, 78; 221/307, 276; 273/129 S

[56] References Cited

U.S. PATENT DOCUMENTS

| | | | |
|---|---|---|---|
| 3,876,201 | 4/1975 | King | 473/446 |
| 5,069,451 | 12/1991 | Martens et al. | 473/446 |
| 5,470,067 | 11/1995 | Diresta | 473/446 |

FOREIGN PATENT DOCUMENTS

| | | | |
|---|---|---|---|
| 1221593 | 5/1987 | Canada | 473/132 |
| 1676643 | 9/1991 | U.S.S.R. | 473/132 |

*Primary Examiner*—Raleigh W. Chiu

[57] ABSTRACT

The present invention relates to a hockey puck storage and delivery system. In its broadest context, the present invention includes a hollow arcuate housing with both a loading end and a discharge end. The intermediate extend of the housing is adapted to store a number of hockey pucks. A discharge device, such as a solenoid actuated plunger, is employed in forcing pucks out through the discharge end of the housing. In this manner, the device can be used in "face-offs" to simulate a referee dropping a puck. The device also includes a spring biased tensioning device which is employed in urging the pucks within the housing toward the discharge end. Further included are means for securing the device to a wall.

5 Claims, 3 Drawing Sheets

HOCKEY PUCK STORAGE AND DELIVERY DEVICE

BACKGROUND OF THE INVENTION

1. Field of the Invention

The present invention relates to a hockey puck storage means and more particularly pertains to such a storage means which also serves as a puck discharging device.

2. Description of the Prior Art

The use of a puck projection devices is known in the prior art. More specifically, puck projection devices are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,069,451 to Martens discloses a hockey practice device. U.S. Pat. No. 5,255,917 to Morrow discloses a puck projecting and guiding apparatus. U.S. Pat. No. 5,161,799 to Nandra discloses a hockey practice apparatus kit. U.S. Pat. No. 5,396,876 to Liscio discloses an apparatus and method for propelling a rolling hockey ball. U.S. Pat. No. 4,607,842 to Daoust discloses a exercising apparatus for use by hockey players to practice their slap shots. Lastly, U.S. Design Pat. No. 321,921 to Johnson discloses a golf ball dispenser.

In this respect, the puck discharging device of the present invention substantially departs from the conventional concepts and designs of the prior art, and in so doing provides an apparatus primarily developed for the purpose of storing and discharging pucks.

Therefore, it can be appreciated that there exists a continuing need for improved puck projecting devices. In this regard, the present invention substantially fulfills this need.

SUMMARY OF THE INVENTION

In view of the foregoing disadvantages inherent in the known types of puck projecting devices now present in the prior art, the present invention provides a puck storage and discharging apparatus. As such, the general purpose of the present invention, which will be described subsequently in greater detail, is to provide a device which will simulate a face-off.

To attain this, the present invention essentially comprises a hockey puck storage and delivery system. In its broadest context, the present invention includes a hollow arcuate housing with both a loading end and a discharge end. The intermediate extend of the housing is adapted to store a number of hockey pucks. A discharge device, such as a solenoid actuated plunger, is employed in forcing pucks out through the discharge end of the housing. In this manner, the device can be used in "face-offs" to simulate a referee dropping a puck. The device also includes a spring biased tensioning device which is employed in urging the pucks within the housing toward the discharge end. Further included are means for securing the device to a wall.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hockey puck storage and delivery device. The device includes an arcuate housing having a discharge end and a loading end and an intermediate hollow extent therebetween. A circular loading aperture is formed within the loading end of the housing for use in placing hockey pucks within the arcuate housing. A pair of parallel apertures are formed within the sides of the arcuate housing. Additionally a discharge aperture is formed within the discharge end of the housing, a flexible material surrounds this discharge aperture for use in keeping a puck in place proximate to (or over) the discharge aperture. A solenoid device is secured to the housing over the discharge end of the housing. This solenoid has a plunger adapted to cooperate with the discharge aperture of the discharge end. Thus, the plunger is adapted to be extended through the discharge aperture and dislodge a hockey puck therefrom. A puck loader is included having a pusher positioned within the hollow interior of the arcuate housing, a pair of arms extending from the pusher and extending outwardly from the parallel apertures within the sides of the arcuate housing. A spring tensioning means is including, with a spring secured between each of the pair of arms and an intermediate location upon the housing. The spring tensioning device thus serves to urge the pusher from the loading end to the discharge end such the hockey pucks positioned within the housing are continually urged to the discharge aperture. securing means are positioned upon an outer surface of the arcuate housing to enable the arcuate housing to be removably secured to a wall.

It is another object of the present invention to provide a device which will randomly drop a hockey puck, similar to a face-off.

It is a further object of the present invention to provide a puck storage and discharging device.

An even further object of the present invention is to provide a puck storage and discharging device which is susceptible of a low cost of manufacture with regard to both materials and labor, and which accordingly is then susceptible of low prices of sale to the consuming public, thereby making such storage and discharging devices economically available to the buying public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

The present invention relates to a hockey puck storage and delivery system. In its broadest context, the present invention includes a hollow arcuate housing with both a loading end and a discharge end. The intermediate extend of the housing is adapted to store a number of hockey pucks. A discharge device, such as a solenoid actuated plunger, is employed in forcing pucks out through the discharge end of the housing. In this manner, the device can be used in "face-offs" to simulate a referee dropping a puck. The device also includes a spring biased tensioning device which is employed in urging the pucks within the housing toward the discharge end. Further included are means for securing the device to a wall. The various components of the present invention, and the manner in which they interrelate, will be described in greater detail hereinafter.

Figures 1, 2:
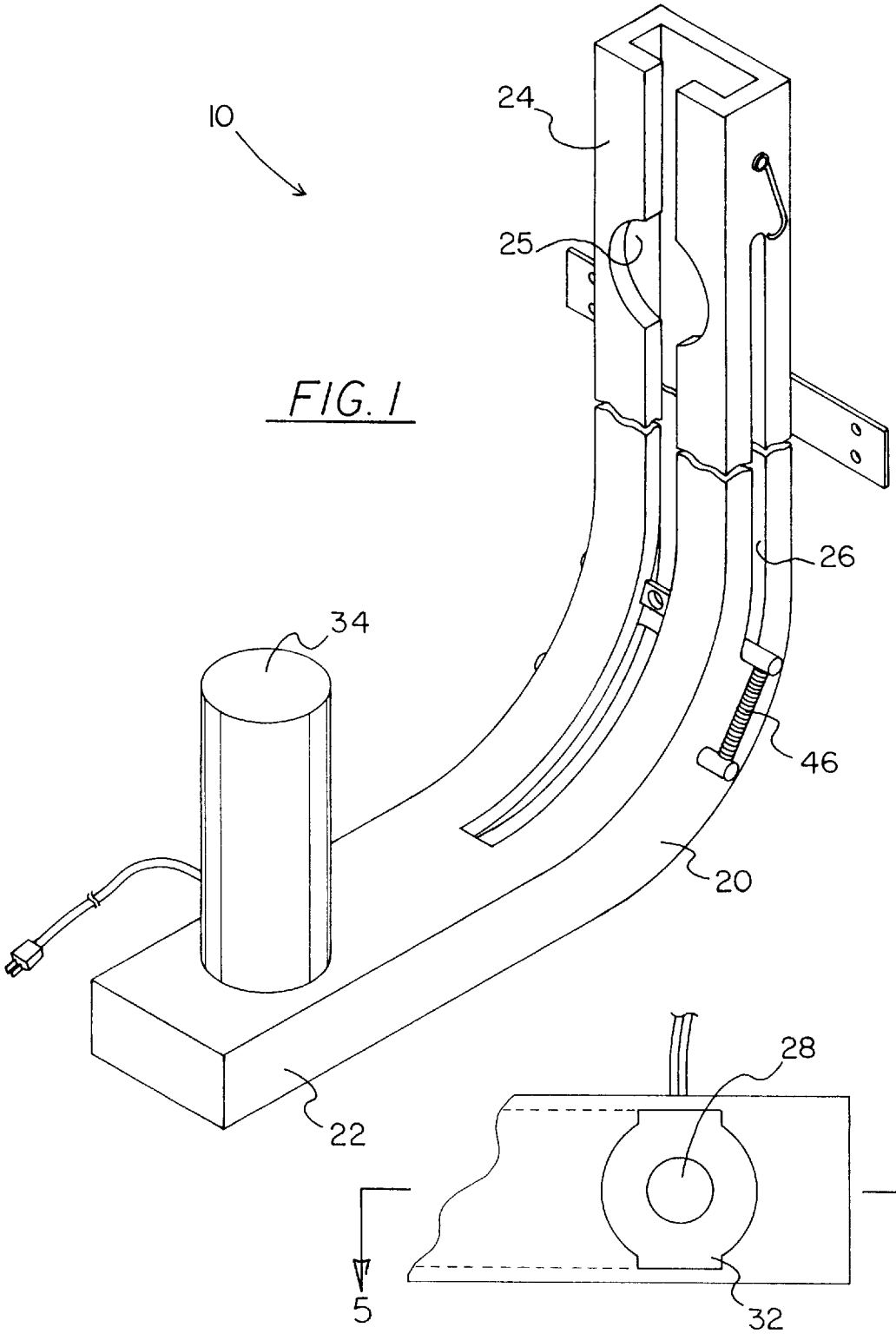
FIG. 1 is a perspective view of the puck storage and discharging device of the present invention.
FIG. 2 is a view of the discharging aperture of the present invention.

With reference to FIG. 1, the housing 20 of the present invention is illustrated. This arcuate housing 20 has a discharge end 22 and a loading end 24 and an intermediate hollow extent therebetween. A number of hockey pucks are adapted to be stored, and travel within, the interior of the housing 20. A circular loading aperture 25 is formed within the loading end 24 of the housing for use in placing hockey pucks within the arcuate housing 20. Additionally, a pair of parallel apertures 26 are formed within the sides of the arcuate housing 20. The function of these parallel apertures 26 will be described in greater detail hereinafter.

Figure 5:
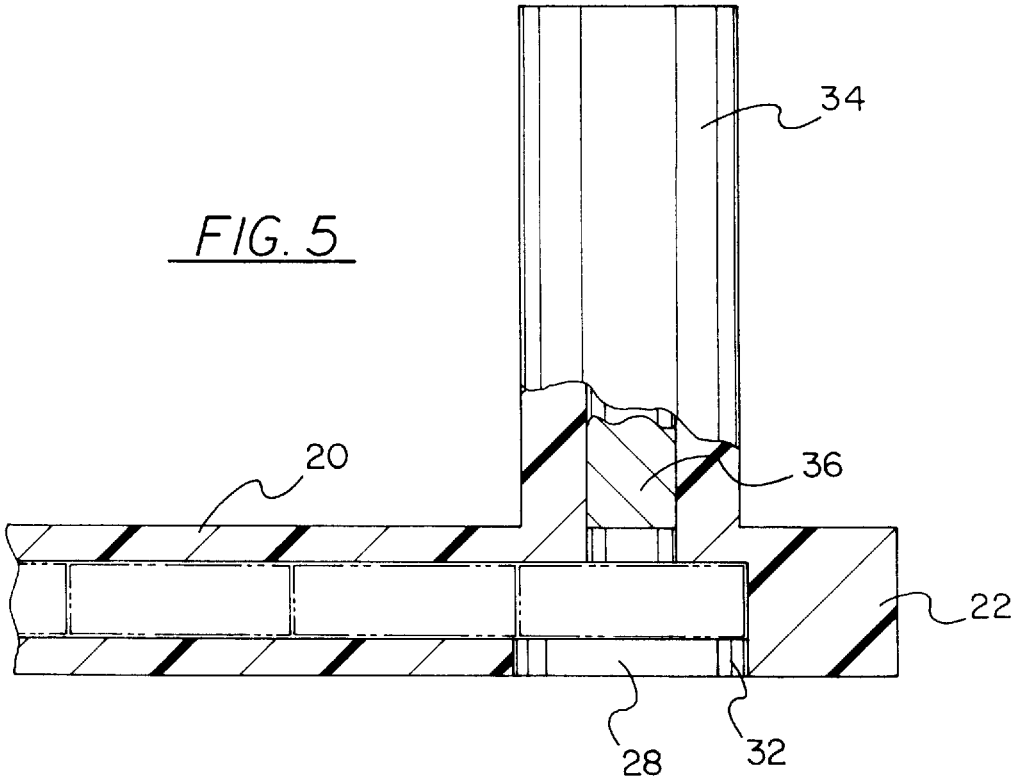
FIG. 5 is a view taken from line 5—5 of FIG. 2.

The housing 20 also includes a discharge aperture 28 which is formed within the discharge end 22 of the housing 20. With reference to FIG. 5, a flexible material 32, such as rubber, surrounds the discharge aperture 28. This flexible material 32 is for use in keeping a puck in place over the discharge aperture 28. Thus, a puck can sit over top of the discharge aperture 28 until forced out in a manner described hereinbelow.

With reference to FIG. 1, a solenoid device 34 is secured to the housing 20 over the discharge end 22 of the housing 20. This solenoid device 34 can be electrically power via an external source of power or a battery and or air. The solenoid includes an internally located plunger 36 which is adapted to cooperate with the discharge aperture 28 of the discharge end 22. More specifically, the plunger 36 cooperates with an aperture with the upper surface of the housing 20 such that the plunger 36 can engage the discharge aperture 28. Thus, the plunger 36 is adapted to be extended through the discharge aperture 28 and dislodge a hockey puck therefrom. The force of the plunger 36 is sufficient to overcome the flexibility of the flexible material 32 surrounding the discharge aperture 28. In this manner, the plunger 36 dislodges the puck from its initial position over the discharge aperture 28. The solenoid plunger 36 can be activated by way of a switch associated with the solenoid. However, in the preferred embodiment, a random timer is associated with the solenoid such that the plunger will be operated at a random interval.

Figure 6:
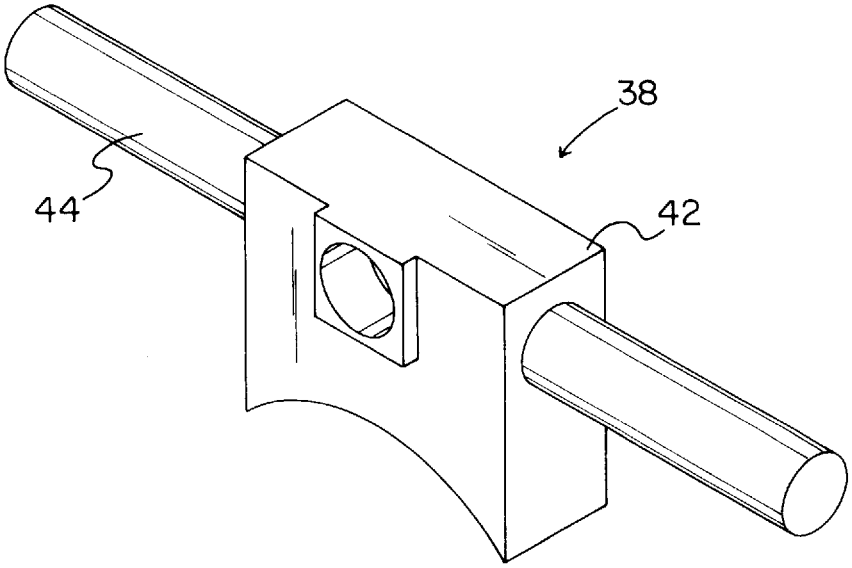
FIG. 6 is view of the pusher and its associated arms.

The puck loading feature of the present invention will next be described. The puck loader 38 has a pusher 42 positioned within the hollow interior of the arcuate housing 20. This pusher has a lower arcuate surface for use in contacting a puck. A centrally located finger aperture is also included for use in manually moving the pusher within the housing. Additionally, a pair of arms 44 extend from the pusher 42 and extending outwardly from the parallel apertures 26 within the sides of the arcuate housing 20. FIG. 6 illustrates the pusher 42, with its associated arms 44, removed from the interior of the housing 20. Additionally, a spring tensioning means is included for use in urging the puck loader 38 towards the discharge end 22 of the housing 20. This tensioning means takes the form of a spring 46 secured between each of the pair of arms 44 and an intermediate location upon the housing 20, note FIG. 1. Each of the springs 46 thus urges the arms of the loader toward the intermediate location of the housing. In this manner the spring tensioning device serves to urge the pusher from the loading end to the discharge end such the hockey pucks positioned within the housing are continually urged to the discharge aperture. In use, the pusher is first brought to the loading end of the housing by way of the finger aperture, Hooks are then employed to keep the pusher at this location while pucks are loaded into the housing. Once a sufficient number of pucks are loaded the hooks can be disengaged.

Figure 3:
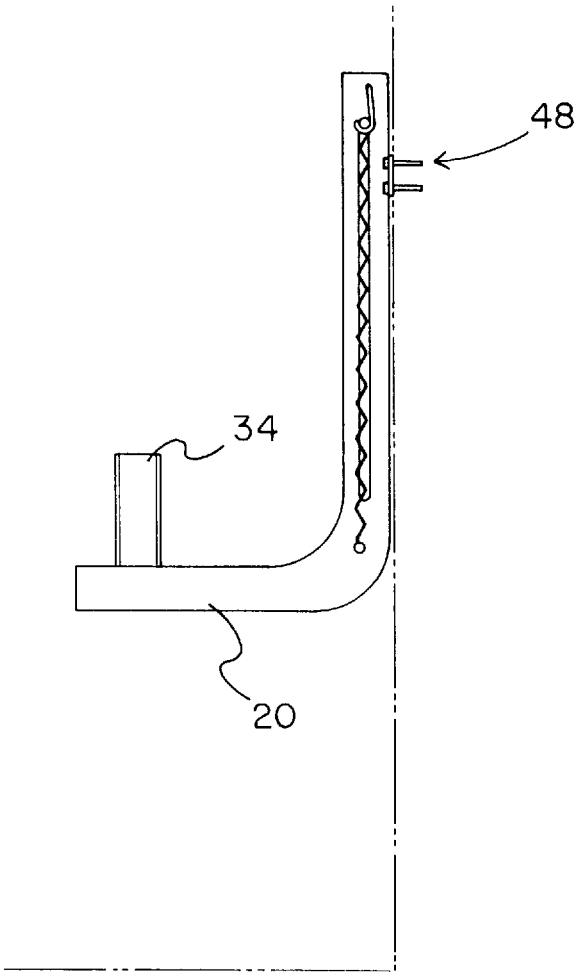
FIG. 3 is a side view of the bracket mounting device.
Figure 4:
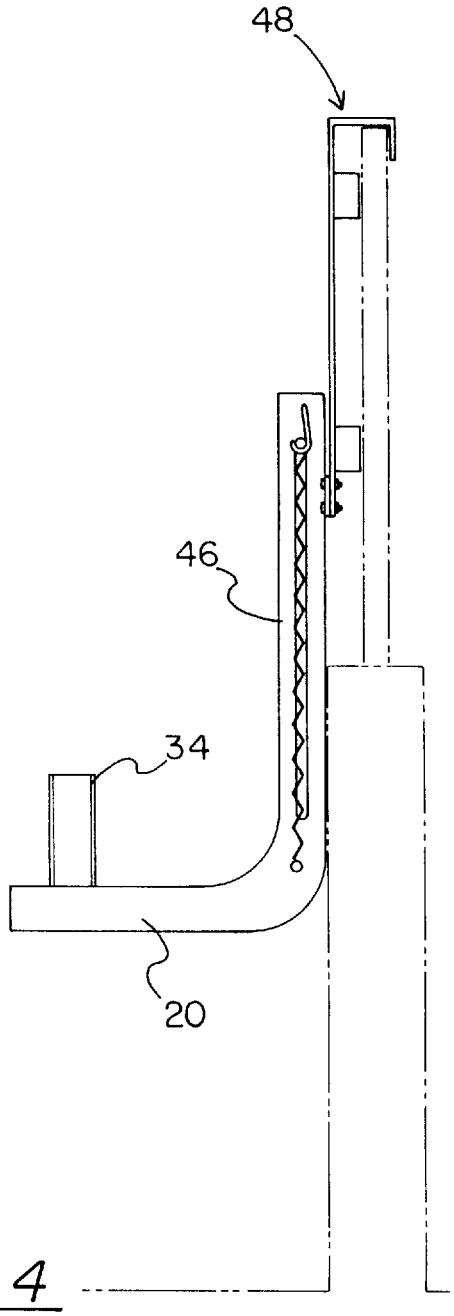
FIG. 4 is a side view of the J-hook mounting device.

Securing means 48 are positioned upon an outer surface of the arcuate housing to enable the arcuate housing to be removably secured to a wall. This securing means 48 may take a number of forms. Specifically, as illustrated in FIG. 1 a bracket can be secured to the rearward surface of the housing. Screws, or other fasteners, are then employed in securing the housing to an associated wall, note FIG. 3. In another embodiment two J-shaped hooks are employed to hang the housing from a wall. In this embodiment, spacing blocks are also employed to prevent any "play" that may exist between the housing and associated wall, note FIG. 4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A hockey puck storage and delivery device comprising in combination:

an arcuate housing having a discharge end and a loading end and an intermediate hollow extent therebetween, a circular loading aperture formed within the loading end of the housing for use in placing hockey pucks within the arcuate housing, a pair of parallel apertures formed within the sides of the arcuate housing; a discharge aperture formed within the discharge end of the housing, a flexible material surrounding the discharge aperture for use in keeping a puck in place proximate to the discharge aperture;

a solenoid device secured to the housing over the discharge end of the housing, the solenoid having a plunger adapted to cooperate with the discharge aperture of the discharge end, the plunger adapted to be extended through the discharge aperture and dislodge a hockey puck therefrom;

a puck loader having a pusher positioned within the hollow interior of the arcuate housing, a pair of arms extending from the pusher and extending outwardly from the parallel apertures within the sides of the arcuate housing, a spring tensioning means including a spring secured between each of the pair of arms and an intermediate location upon the housing, the spring tensioning device thus serving to urge the pusher from the loading end to the discharge end such the hockey pucks positioned within the housing are continually urged to the discharge aperture;

securing means positioned upon an outer surface of the arcuate housing to enable the arcuate housing to be removably secured to a wall.

2. A hockey puck storage and delivery device comprising in combination:

an arcuate housing having a discharge end and a loading end and an intermediate hollow extent therebetween, a circular loading aperture formed within the loading end of the housing for use in placing hockey pucks within the arcuate housing, a discharge aperture formed within the discharge end of the housing;

a solenoid device secured to the housing over the discharge end of the housing, the solenoid having a plunger adapted to cooperate with the discharge aperture of the discharge end, the plunger adapted to be extended through the discharge aperture and dislodge a hockey puck therefrom.

3. The hockey puck storage and discharging device as described in claim 2 further comprising:

securing means positioned upon an outer surface of the arcuate housing to enable the arcuate housing to be removably secured to a wall.

4. The hockey puck storage and discharging device as described in claim 2 further comprising:

a pair of parallel apertures formed within the sides of the arcuate housing; and a puck loader having a pusher positioned within the hollow interior of the arcuate housing, a pair of arms extending from the pusher and extending outwardly from the parallel apertures within the sides of the arcuate housing, a spring tensioning means including a spring secured between each of the pair of arms and an intermediate location upon the housing, the spring tensioning device thus serving to urge the pusher from the loading end to the discharge end such the hockey pucks positioned within the housing are continually urged to the discharge aperture.

5. The hockey puck storage and discharging device as described in claim 2 further comprising:

a flexible material surrounding the discharge aperture for use in keeping a puck in place over the discharge aperture.

* * * * *